US009840864B2

(12) United States Patent
Chen et al.

(10) Patent No.: US 9,840,864 B2
(45) Date of Patent: Dec. 12, 2017

(54) HINGE AND DAMPING DEVICE

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 15/261,993

(22) Filed: Sep. 11, 2016

(65) Prior Publication Data

US 2017/0152694 A1 Jun. 1, 2017

(30) Foreign Application Priority Data

Nov. 26, 2015 (TW) ..... 104139602 A

(51) Int. Cl.
*E05D 7/00* (2006.01)
*E05F 1/08* (2006.01)
(Continued)

(52) U.S. Cl.
CPC ..... *E05F 5/10* (2013.01); *E05F 5/006* (2013.01); *E05Y 2201/21* (2013.01);
(Continued)

(58) Field of Classification Search
CPC ..... E05Y 2900/20; E05Y 2900/202; E05Y 2900/204; E05Y 2900/208; E05Y 2201/20; E05Y 2201/21; E05Y 2201/256; E05Y 2201/264; E05Y 2201/266; E05Y 2201/638; E05F 5/006; E05F 5/02; E05F 5/10; E05F 5/027; E05D 11/1021;
(Continued)

(56) References Cited

U.S. PATENT DOCUMENTS 4,078,779 A * 3/1978 Molders ..... F16F 9/0254 188/300
4,596,383 A * 6/1986 Howard ..... F16F 9/0254 16/84
(Continued)

FOREIGN PATENT DOCUMENTS

AT 506 643 A1 10/2009
DE 102011050053 A1 * 11/2012 ..... E05F 5/006
(Continued)

*Primary Examiner* — Chuck Mah
(74) *Attorney, Agent, or Firm* — Winston Hsu

(57) ABSTRACT

A damping device is applicable to a hinge. The damping device includes a damper and a blocking member. The damper includes a first movable member and a second movable member movable relative to each other. The first movable member has a first abutting part and a second abutting part. The first abutting part and the second abutting part are located at different longitudinal positions on the first movable member. The blocking member is movable relative to the damper and configured to abut against one of the first abutting part and the second abutting part of the first movable member.

18 Claims, 18 Drawing Sheets

(51) Int. Cl.
*E05F 5/00* (2017.01)
*E05F 5/10* (2006.01)

(52) U.S. Cl.
CPC ... *E05Y 2201/214* (2013.01); *E05Y 2201/256* (2013.01); *E05Y 2201/264* (2013.01); *E05Y 2600/12* (2013.01); *E05Y 2900/20* (2013.01)

(58) Field of Classification Search
CPC ..... E05D 11/1042; E05D 11/105; E05D 11/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS 4,639,969 A * 2/1987 Obenshain ..... E05F 3/221 16/65
6,273,405 B2 * 8/2001 Okamoto ..... F16F 9/0254 188/300
7,134,168 B1 * 11/2006 Qing ..... E05F 3/221 16/66
7,275,284 B2 10/2007 Lautenschlager
7,552,509 B2 * 6/2009 Chen ..... E05F 5/10 16/286
7,874,043 B2 1/2011 Salice
7,917,995 B2 4/2011 Salice
7,966,696 B2 6/2011 Krammer
7,971,691 B2 7/2011 Holzapfel
8,307,498 B2 11/2012 Krammer
8,561,262 B1 * 10/2013 Liang ..... E05F 5/006 16/286
8,650,711 B1 * 2/2014 Chen ..... E05F 5/006 16/286
9,057,214 B2 * 6/2015 Salice ..... E05F 5/006
9,163,447 B1 * 10/2015 Liang ..... E05F 5/006
2012/0167340 A1 * 7/2012 Zhang ..... E05F 3/221 16/65
2012/0180262 A1 * 7/2012 Zimmer ..... E05F 5/006 16/319
2013/0145580 A1 * 6/2013 Brunnmayr ..... E05F 5/006 16/277
2013/0160242 A1 * 6/2013 Brunnmayr ..... E05F 5/006 16/286
2013/0239363 A1 9/2013 Çapur
2014/0345081 A1 * 11/2014 Salice ..... E05F 5/006 16/50
2014/0352111 A1 * 12/2014 Ng ..... E05F 5/02 16/286

FOREIGN PATENT DOCUMENTS

JP 2011517477 A 6/2011
WO WO 2010114500 A1 * 10/2010 ..... E05F 5/006

* cited by examiner

HINGE AND DAMPING DEVICE

BACKGROUND OF THE INVENTION

1. Field of the Invention

The present invention relates to a hinge, and more particularly, to a hinge with a damping device.

2. Description of the Prior Art

Generally, a damping device is applicable to a first object and a second object movable relative to each other, in order to provide damping effect when the second object is moved to switch from an open state to a close state relative to the first object, so as to mitigate movement of the second object being closed relative to the first object. For example, US patent numbers U.S. Pat. No. 7,971,691 B2 discloses a damper for movable furniture parts. The damper comprises a housing, a cylinder arranged in the housing, a piston with a piston rod movable relative to the cylinder, a stop for abutting against the piston rod and a transmission arranged on the housing and configured to adjust the stop to move along a longitudinal direction of the piston rod. Wherein, according to an embodiment of the case shown in FIG. 1*a*, an actuation element (9) is configured to be driven by a tool, such as a screwdriver to spirally adjust the stop (7, 14) to move longitudinally, in order to adjust the piston rod. The case provides an adjustable damper. However, for different market requirements, dampers with different damping-stroke adjusting methods can be provided to bring more options to the market.

SUMMARY OF THE INVENTION

The present invention relates to a damping device comprising a damper, and the damping device has a plurality of abutting parts located at different positions.

According to an embodiment of the present invention, a damping device comprises a damper and a blocking member. The damper comprises a first movable member and a second movable member longitudinally movable relative to each other. The first movable member has a first abutting part and a second abutting part. The first abutting part and the second abutting part are located at different longitudinal positions on the first movable member. The blocking member is movable relative to the damper and configured to abut against one of the first abutting part and the second abutting part of the first movable member.

According to the above embodiment, the damping device further comprises an adjusting member configured to adjust the blocking member to transversely move relative to the damper.

Preferably, the damping device further comprises a housing having a passage configured to accommodate the damper. The adjusting member is arranged adjacent to the housing.

Preferably, the housing further comprises an auxiliary base arranged adjacent to the passage. The auxiliary base has a plurality of engaging features. The blocking member is arranged on the auxiliary base, and the blocking member has a positioning feature configured to be engaged with one of the plurality of engaging features.

Preferably, the blocking member has an opening. The adjusting member comprises a first fastening member and a second fastening member penetrating through the opening and fastened to each other.

Preferably, the first movable member further has a third abutting part located at a longitudinal position different from the longitudinal positions of the first abutting part and the second abutting part on the first movable member. The blocking member comprises a main body and a flexible part connected to the main body. The flexible part is configured to selectively abut against one of the first abutting part, the second abutting part and the third abutting part.

According to the above embodiment, the first movable member of the damper is a cylinder, and the second movable member of the damper is a piston rod.

According to another embodiment of the present invention, a damping device is applicable to two components movable relative to each other. One of the two components has a contact part. The damping device comprises a housing, a damper and a blocking member. The damper is arranged in the housing. The damper comprises a first movable member and a second movable member longitudinally movable relative to each other. A length is defined by the first movable member and the second movable member. The first movable member has a first abutting part and a second abutting part. The first abutting part and the second abutting part are located at different longitudinal positions on the first movable member. The second movable member is configured to abut against the contact part. The blocking member is movable relative to the damper and configured to abut against one of the first abutting part and the second abutting part of the first movable member in order to adjust the distance.

According to yet another embodiment of the present invention, a hinge comprises a first component, a second component, an elastic member, a linkage member and a damping device. The first component comprises a contact part. The second component is pivoted to the first component. The elastic member is configured to provide an elastic force when the second component is opened or closed relative to the first component. The linkage member is configured to move when the second component is rotated relative to the first component. The damping device is mounted to one of the first component and the second component. The damping device comprises a damper and a blocking member. The damper comprises a first movable member and a second movable member longitudinally movable relative to each other. The first movable member has a first abutting part and a second abutting part. The first abutting part and the second abutting part are located at different longitudinal positions on the first movable member. The second movable member faces toward the contact part of the first component. The blocking member is movable relative to the damper and configured to abut against one of the first abutting part and the second abutting part of the first movable member. Wherein, when the second component is moved to switch from an open state to a close state relative to the first component with the blocking member abutting against one of the first abutting part and the second abutting part of the first movable member, the linkage member is moved toward the first movable member of the damper.

According to the yet another embodiment of the present invention, the first movable member further has a third abutting part located at a longitudinal position different from the longitudinal positions of the first abutting part and the second abutting part on the first movable member.

Preferably, the damping device further comprises an adjusting member configured to adjust the blocking member to transversely move relative to the damper for abutting against one of the first abutting part, the second abutting part and the third abutting part of the first movable member.

Preferably, the damping device further comprises a housing arranged on the first component. The housing has a passage configured to accommodate the damper. The adjusting member is arranged adjacent to the housing.

Preferably, the blocking member comprises a main body and a flexible part connected to the main body. The main body has an opening. The adjusting member comprises a first fastening member and a second fastening member penetrating through the opening and fastened to each other. The flexible part of the blocking member is configured to selectively abut against one of the first abutting part, the second abutting part and the third abutting part.

Preferably, the hinge further comprises a sleeve member detachably mounted to the contact part of the first component. The sleeve member is configured to abut against the second movable member of the damper.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
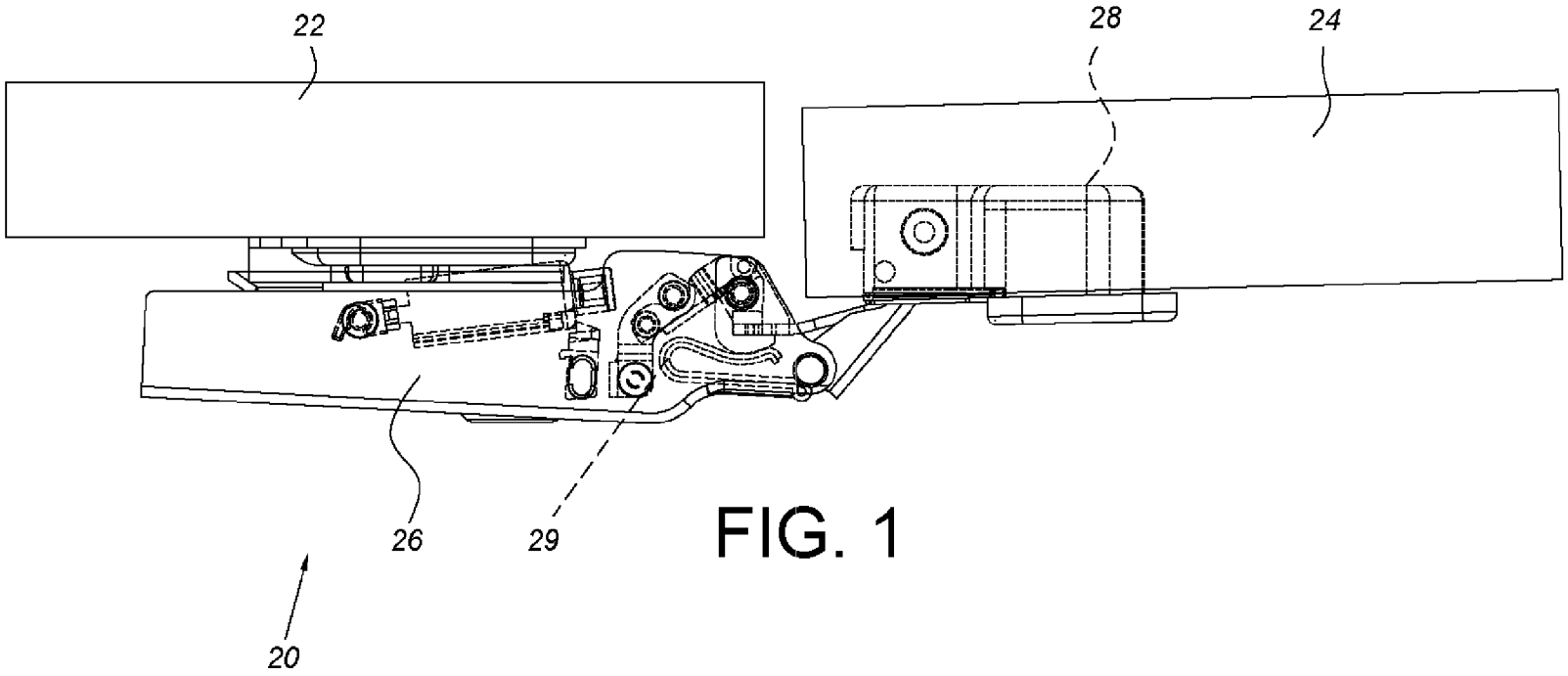
FIG. 1 is a diagram showing a hinge applicable to two objects being in an open state according to an embodiment of the present invention.
Figure 2:
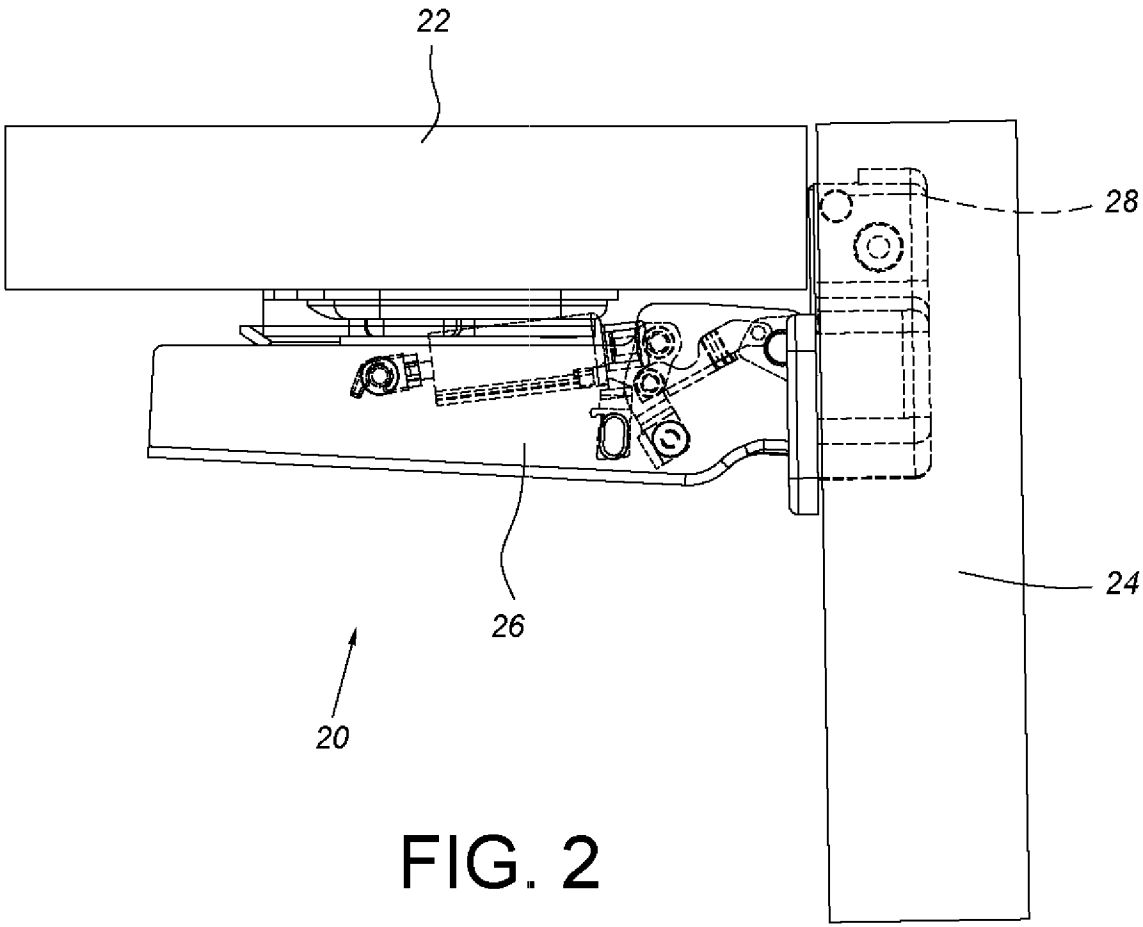
FIG. 2 is a diagram showing the two objects in FIG. 1 being in a close state.

FIG. 1 and FIG. 2 are diagrams showing a hinge 20 applicable to two objects movable relative to each other according to an embodiment of the present invention. In the present embodiment, the two objects can be a first furniture part 22 and a second furniture part 24 for example. The hinge 20 comprises a first component 26 mounted to the first furniture part 22, and a second component 28 mounted to the second furniture part 24. The first component 26 can be a hinge arm. The second component 28 can be a hinge cup. Wherein, the second component 28 is pivoted to the first component 26, such that the second furniture part 24 can be opened or closed relative to the first furniture part 22. The hinge 20 further comprises at least one elastic member 29 configured to provide an elastic force when the second component 28 is opened or closed relative to the first component 26.

Figure 3:
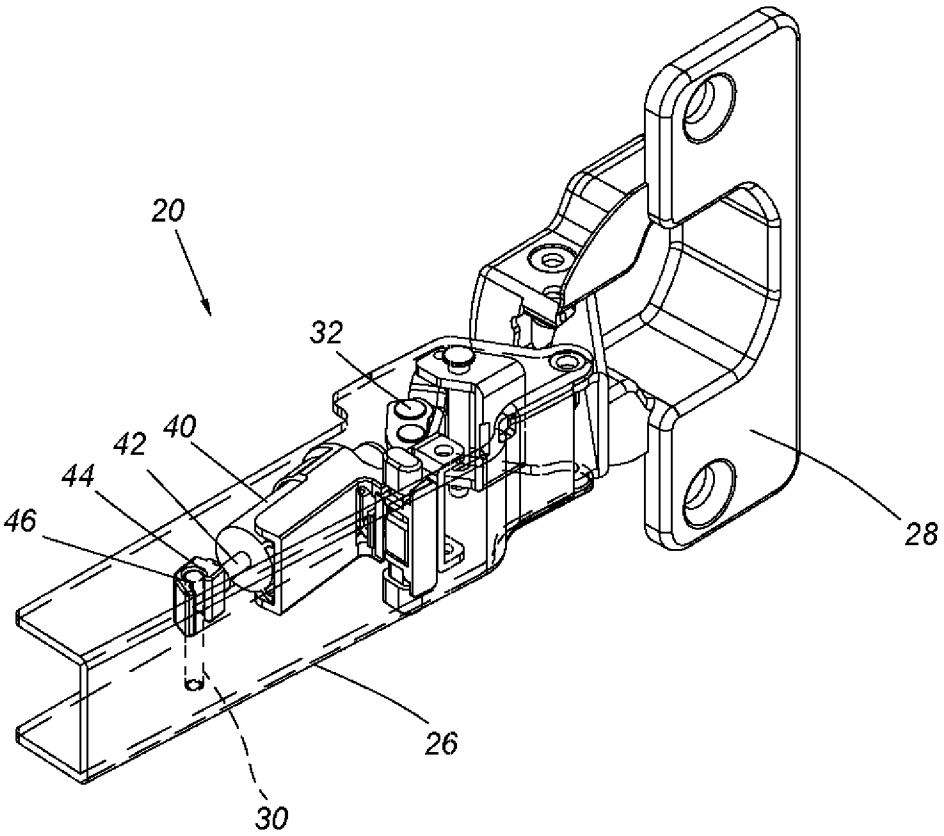
FIG. 3 is a diagram showing the hinge according to an embodiment of the present invention.
Figure 4:
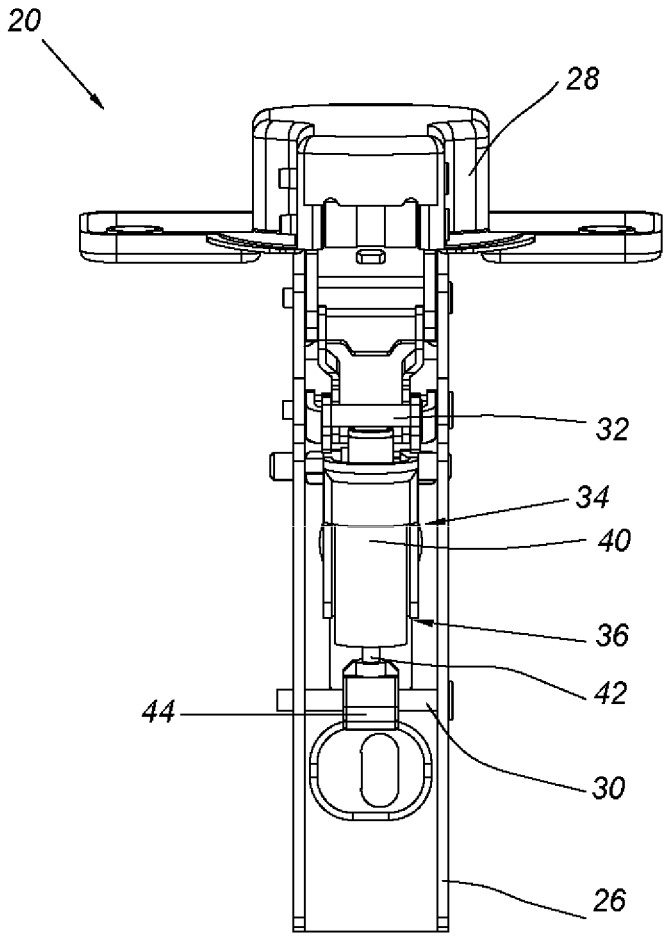
FIG. 4 is a top view of the hinge according to an embodiment of the present invention.

As shown in FIG. 3 and FIG. 4, the first component 26 of the hinge 20 comprises a contact part 30, such as a supporting shaft. In particular, the hinge 20 further comprises a linkage member 32 and a damping device 34. The linkage member 30 is configured to abut against the damping device 34 in response to the second component 28 moving toward a close position relative to the first component 26, in order to mitigate a force for closing. The damping device 34 can be mounted to one of the first component 26 and the second component 28. In the present embodiment, the damping device 34 is mounted to the first component 26 for example.

Figure 5:
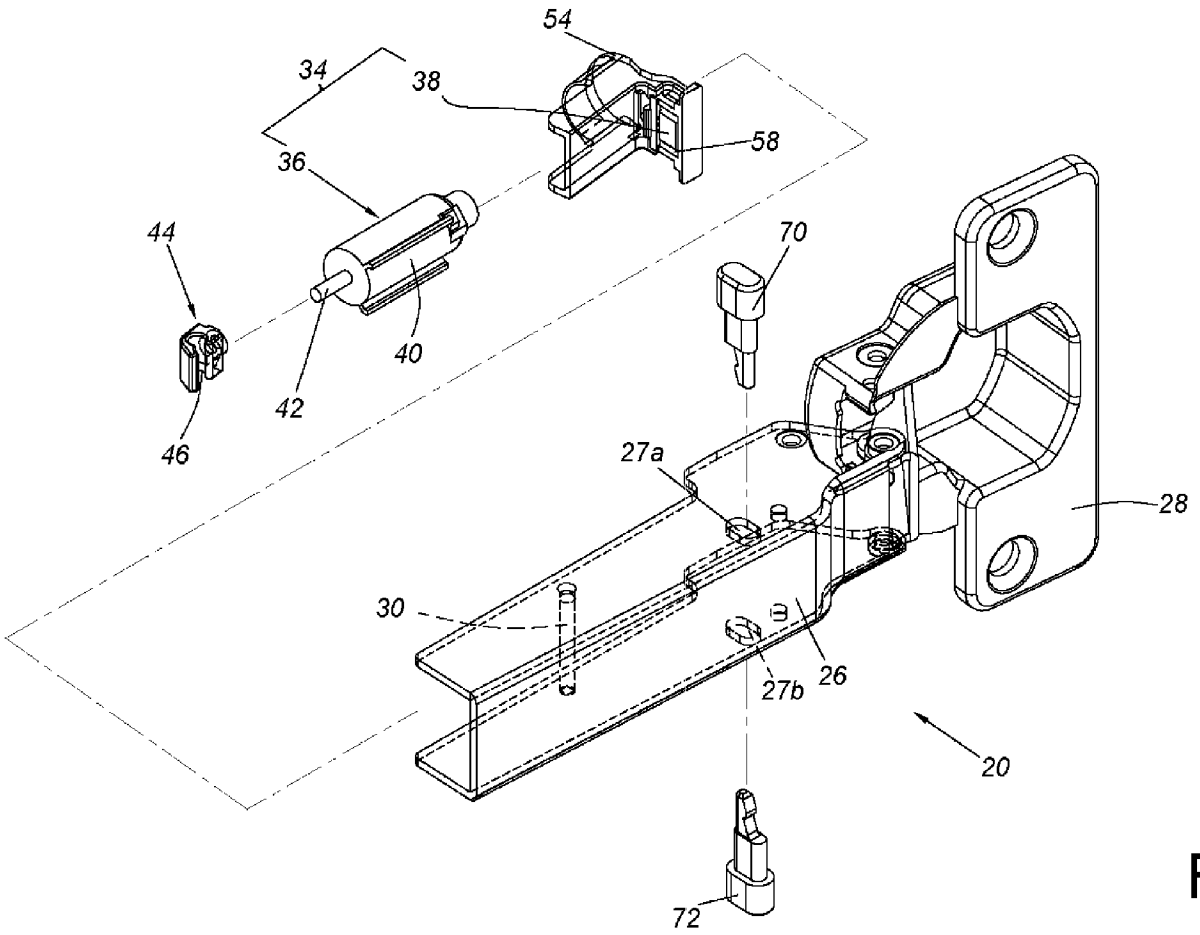
FIG. 5 is an exploded view of the hinge with a damping device according to an embodiment of the present invention.

As shown in FIG. 5, the damping device 34 comprises a damper 36 and a blocking member 38. The damper 36 is configured to provide damping effect. The damper 36 comprises a first movable member 40 and a second movable member 42 longitudinally movable relative to each other. In the present embodiment, the first movable member 40 can be a cylinder, and the second movable member can be a piston rod constantly driven by a force to extend out of the cylinder. Wherein, operation of the cylinder and the piston rod is well known to those skilled in the art, therefore, no further illustration is provided. In the present embodiment, the hinge 20 further comprises a sleeve member 44 detachably mounted to the contact part 30 of the first component 26. For example, the sleeve member 44 has a fastening part 46 configured to be engaged with the contact part 30. The second movable member 42 of the damper 36 faces toward the contact part 30 of the first component 26. In the present embodiment, the second movable member 42 abuts against the contact part 30 of the first component 26 through the sleeve member 44.

Figure 6:
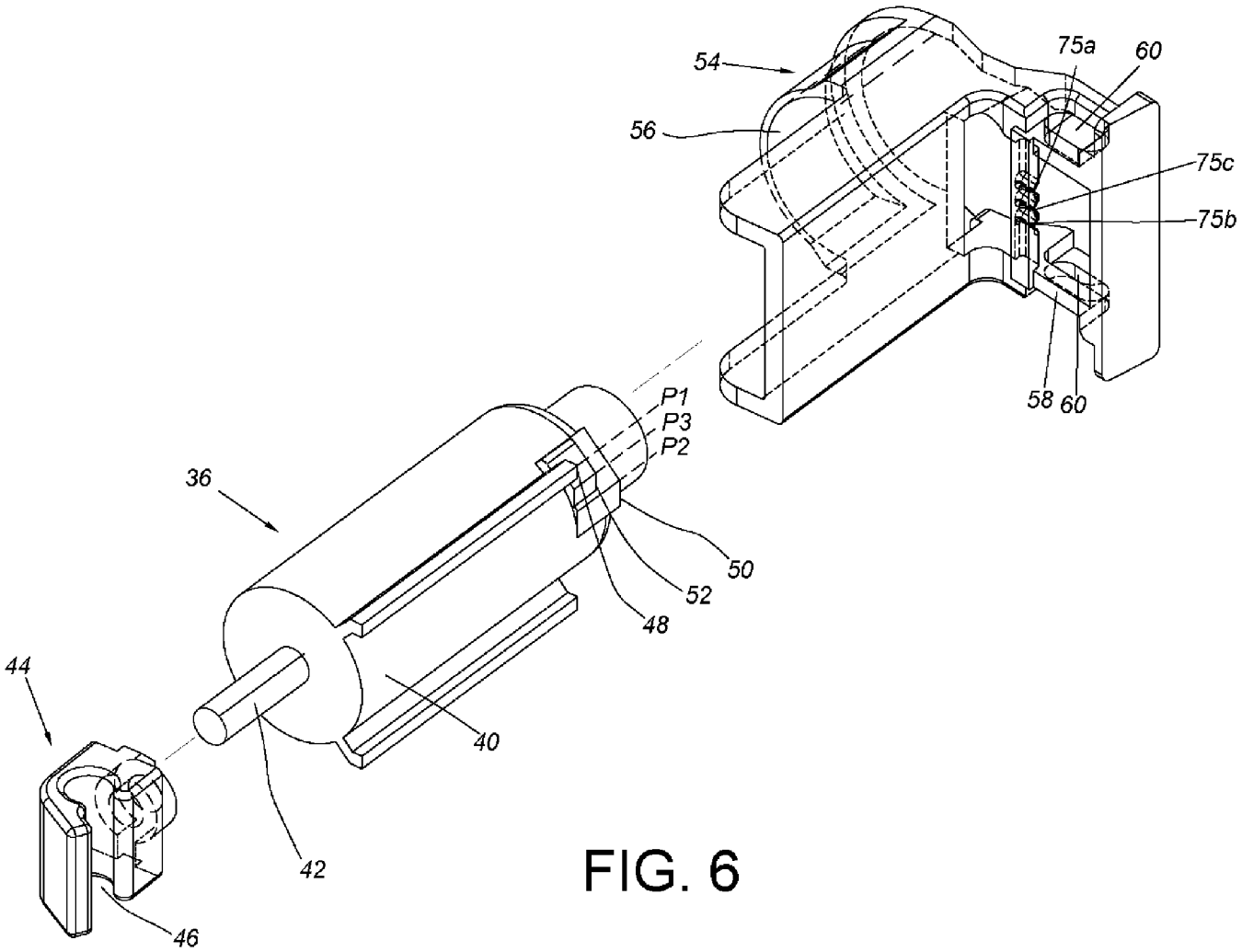
FIG. 6 is an exploded view of the damping device according to an embodiment of the present invention.

As shown in FIG. 5 and FIG. 6, the first movable member 40 of the damper 36 has a first abutting part 48 and a second abutting part 50. Preferably, the first movable member 40 further comprises a third abutting part 52. The first abutting part 48, the second abutting part 50 and the third abutting part 52 are located at different longitudinal positions on the first movable member 40. For example, the first abutting part 48 is located at a first longitudinal position P1 on the first movable member 40; the second abutting part 50 is located at a second longitudinal position P2 on the first movable member 40; the third abutting part 52 is located at a third longitudinal position P3 on the first movable member 40. Preferably, the hinge 20 in the present embodiment further comprises a housing 54 arranged on the first component 26. The housing 54 comprises a passage 56 and an auxiliary base 58 arranged adjacent to the passage 56. The passage 56 is configured to accommodate the damper 36, such as accommodating the first movable member 40 of the damper 36. The auxiliary base 58 has a pair of mounting holes 60.

Figure 7:
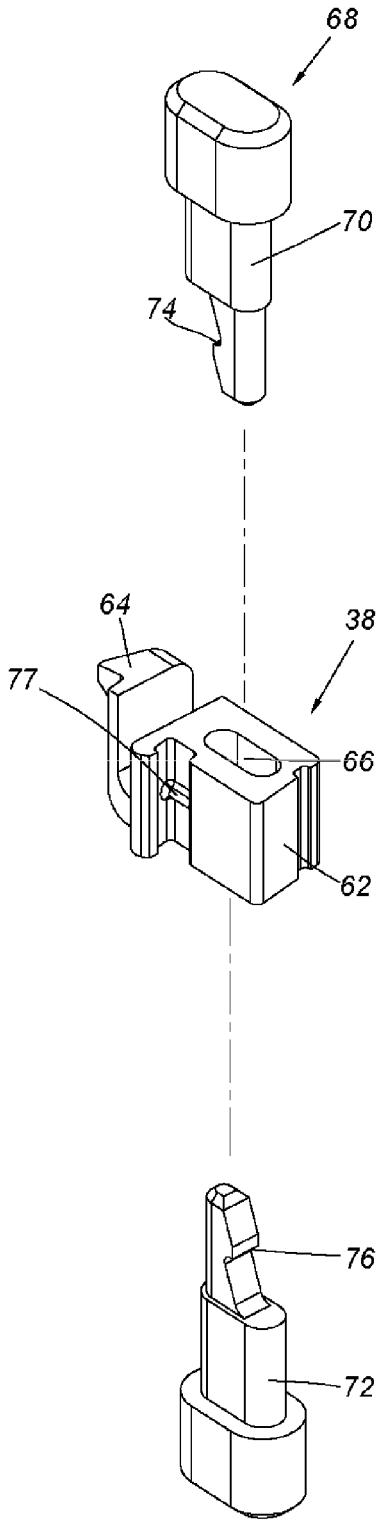
FIG. 7 is an exploded view of an adjusting member and a blocking member according to an embodiment of the present invention.

As shown in FIG. 5, FIG. 6 and FIG. 7, the blocking member 38 can be arranged on the auxiliary base 58. The blocking member 38 comprises a main body 62 and a flexible part 64 connected to the main body 62. The main body 62 has an opening 66. Preferably, the damping device further comprises an adjusting member 68 arranged on the blocking member 38. The adjusting member 68 comprises a first fastening member 70 and a second fastening member 72 respectively having a first hook part 74 and a second hook part 76. The first fastening member 70 and the second fastening member 72 penetrates through the opening 66 of the blocking member 38 via predetermined holes 27*a*, 27*b* on the first component 26 of the hinge 20 and the mounting holes 60 of the auxiliary base 58. The first fastening member 70 and the second fastening member 72 are engaged with each other by the first hook part 74 and the second hook part 76. The first fastening member 70 and the second fastening member 72 are respectively located at two sides of the blocking member 38 and extended out of the first component 26 of the hinge 20 in order to facilitate operation for pushing the blocking member 38 to move. Preferably, the auxiliary base 58 of the housing 54 has a plurality of engaging features, such as a first engaging feature 75*a*, a second engaging feature 75*b* and a third engaging feature 75*c*. On the other hand, the blocking member 38 has a positioning feature 77. In the present embodiment, the engaging features 75*a*, 75*b* and 75*c* can be grooves, and the positioning feature 77 can be a protrusion.

Figure 9:
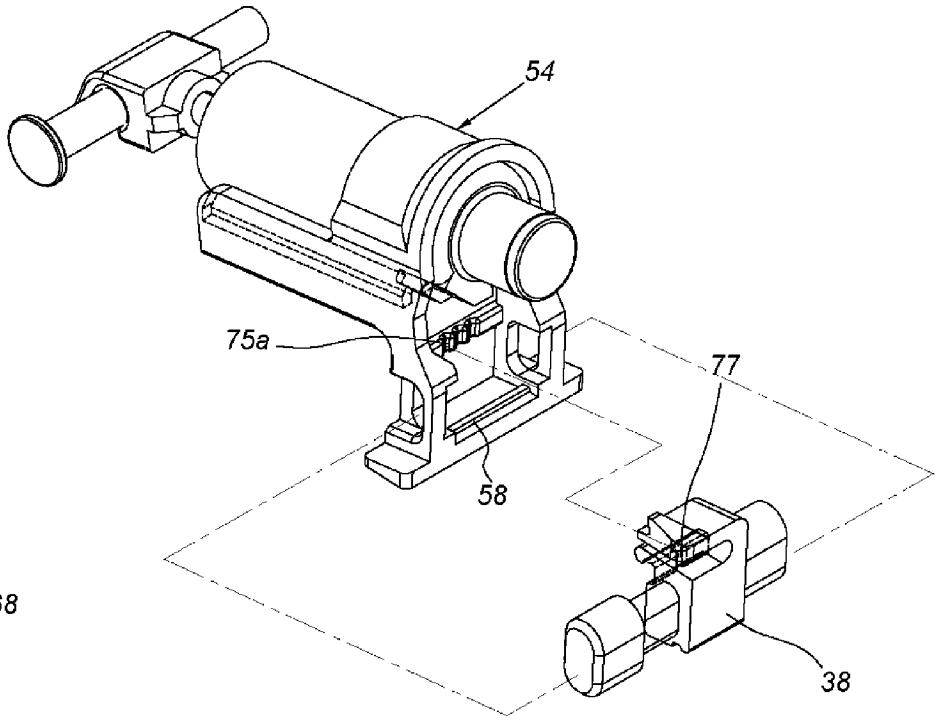
FIG. 9 is a diagram showing a housing of the damping device in FIG. 8 having a first engaging feature configured to engage with the blocking member when the blocking member is located at the first position.
Figure 8:
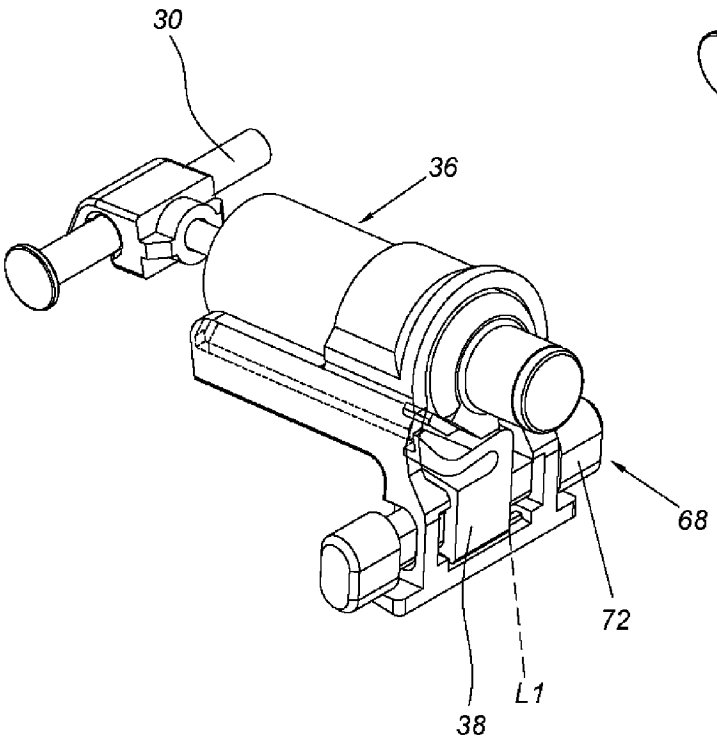
FIG. 8 is a diagram showing the blocking member being adjusted to move to a first position relative to a damper.

As shown in FIG. 8 and FIG. 9, the blocking member 38 is movable relative to the damper 36. In particular, when a user operates the adjusting member 68, such as pushing the second fastening member 72 of the adjusting member 68, to adjust the blocking member 38 to transversely move relative to the damper 36 to a first position L1, the positioning feature 77 of the blocking member 38 is correspondingly engaged with the first engaging feature 75*a* of the auxiliary base 58 of the housing 54.

Figure 11:
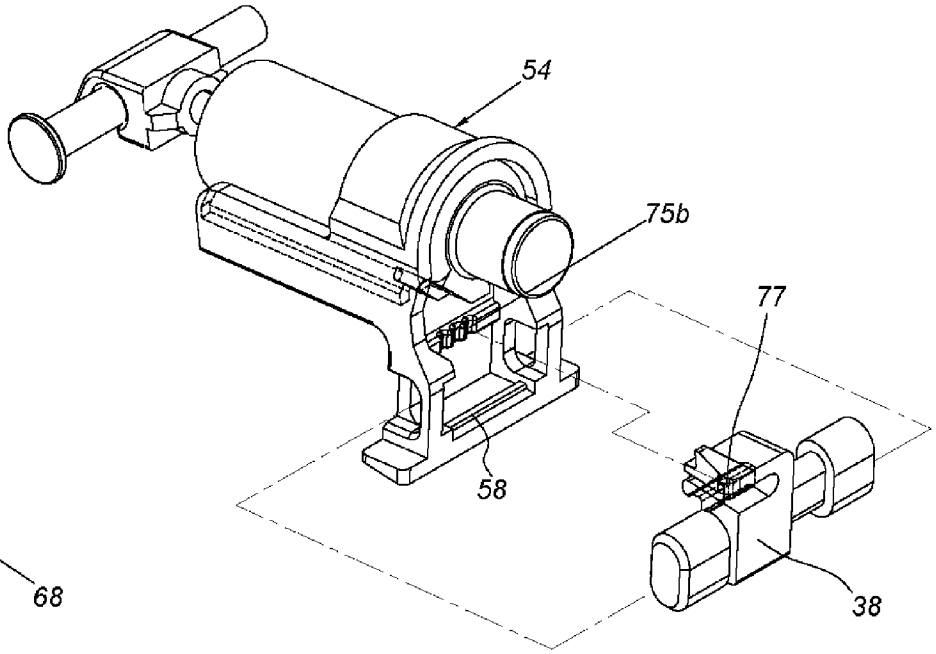
FIG. 11 is a diagram showing the housing of the damping device in FIG. 10 having a second engaging feature configured to engage with the blocking member when the blocking member is located at the second position.
Figure 10:
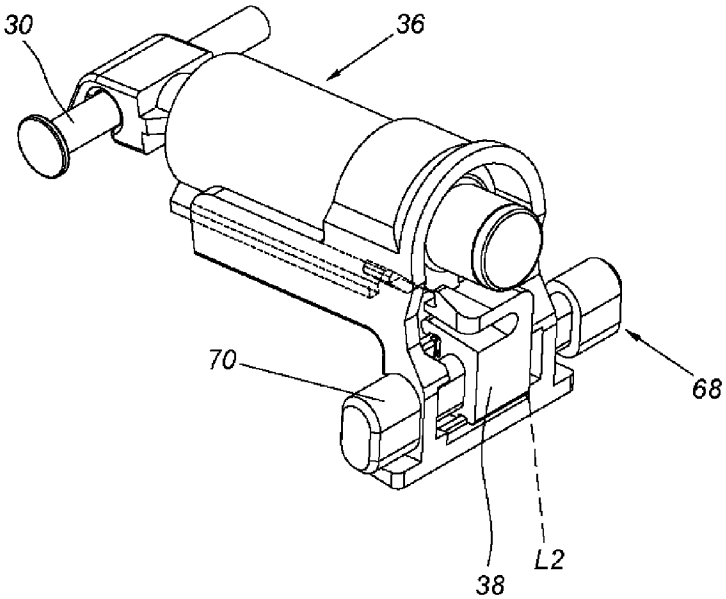
FIG. 10 is a diagram showing the blocking member being adjusted to move to a second position relative to the damper.

As shown in FIG. 10 and FIG. 11, when the user operates the adjusting member 68, such as pushing the first fastening member 70 of the adjusting member 68, to adjust the blocking member 38 to transversely move relative to the damper 36 to a second position L2, the positioning feature 77 of the blocking member 38 is correspondingly engaged with the second engaging feature 75*b* of the auxiliary base 58 of the housing 54.

Figure 13:
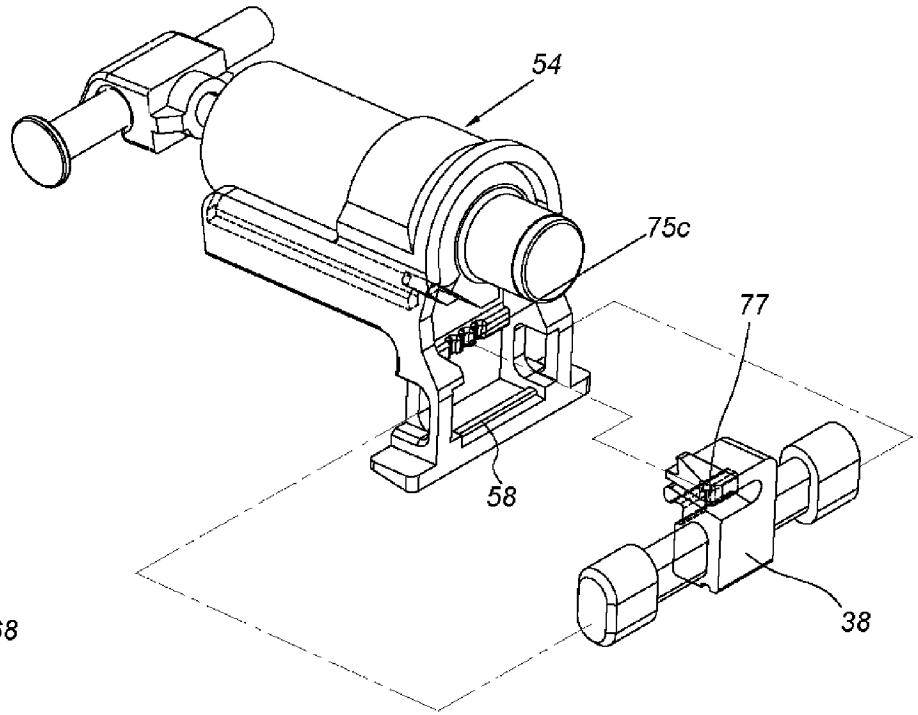
FIG. 13 is a diagram showing the housing of the damping device in FIG. 12 having a third engaging feature configured to engage with the blocking member when the blocking member is located at the third position.
Figure 12:
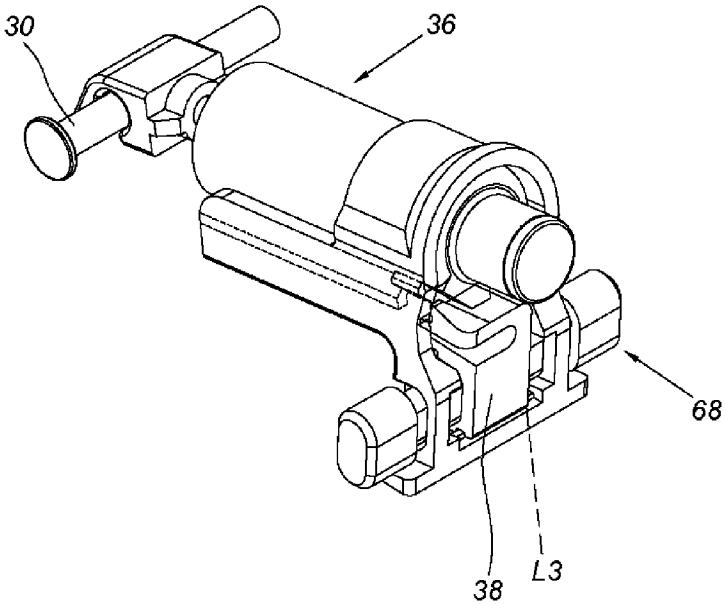
FIG. 12 is a diagram showing the blocking member being adjusted to move to a third position relative to the damper.
Figure 14A:
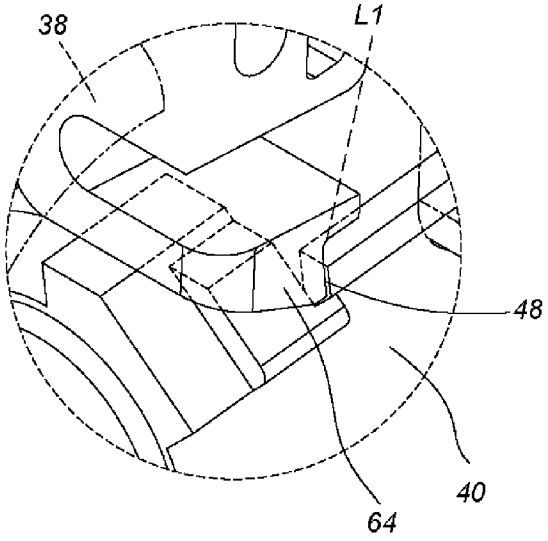
FIG. 14A is an enlarged view of an area 14A in FIG. 14.
Figure 14:
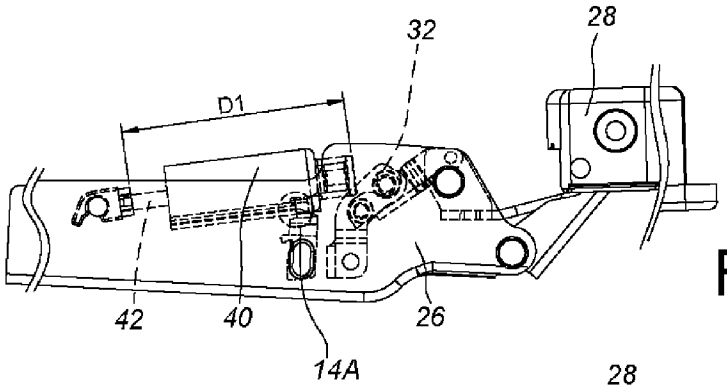
FIG. 14 is a diagram showing the hinge being in an open state according to an embodiment of the present invention, wherein the blocking member abuts against a first abutting part of the damper.
Figure 15:
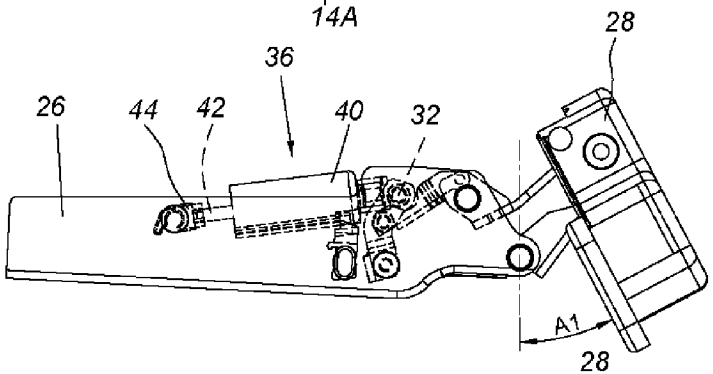
FIG. 15 is a diagram showing a linkage member pushing the damper in a process of the hinge in FIG. 14 being moved to switch from the open state to a close state when a second component of the hinge is at a first angle.
Figure 16:
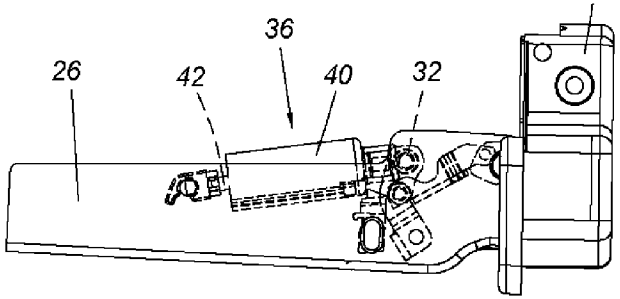
FIG. 16 is a diagram showing the hinge in FIG. 15 being in the close state.

As shown in FIG. 12 and FIG. 13, when the user operates the adjusting member 68 to adjust the blocking member 38 to transversely move relative to the damper 36 to a third position L3, the positioning feature 77 of the blocking member 38 is correspondingly engaged with the third engaging feature 75*c* of the auxiliary base 58 of the housing 54.

As shown in FIG. 14, FIG. 14A, FIG. 15 and FIG. 16, when the blocking member 38 is adjusted to move to the first position L1, the flexible part 64 of the blocking member 38 abuts against the first abutting part 48 of the first movable member 40 of the damper 36, such that a first length D1 is defined by the first movable member 40 and the second movable member 42 of the damper 36. In such state, during a process of the second component 28 being moved to switch from an open state to a close state relative to the first component 26, the linkage member 32 is moved toward the first movable member 40 of the damper 36 along with the second component 28 rotating relative to the first component 26. Wherein, the linkage member 32 starts to push the first movable member 40 of the damper 36 when the second component 28 is moved relative to the first component 26 to be at a first angle A1. On the other hand, the second movable member 42 of the damper 36 abuts against the sleeve member 44. As such, when the linkage member 32 continues to push the first movable member 40 of the damper 36, the first movable member 40 of the damper 36 is moved relative to the second movable member 42 according to a damping stroke corresponding to the first length D1, in order to provide a first damping effect to mitigate movement of the second component 28 being closed relative to the first component 26. In other words, the first damping effect is provided when the second furniture part 24 is closed relative to the first furniture part 22.

Figure 17A:
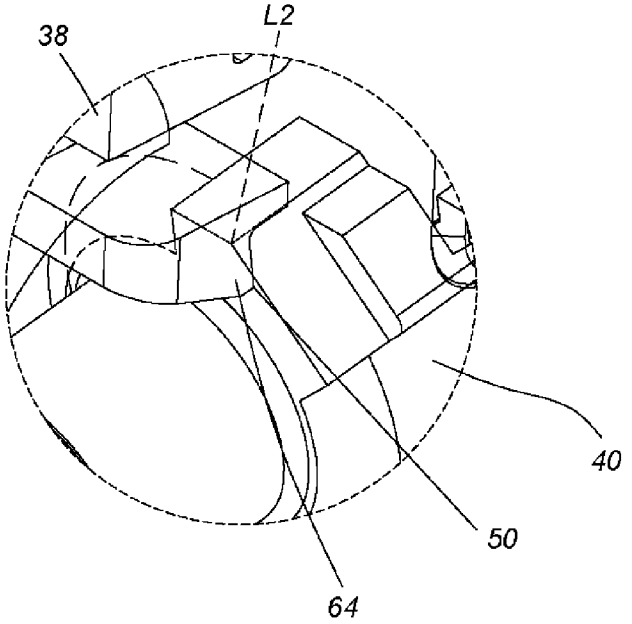
FIG. 17A is an enlarged view of an area 17A in FIG. 17.
Figure 17:
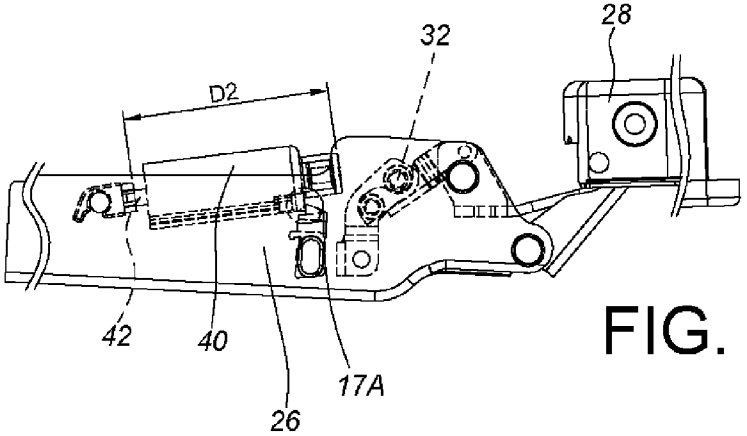
FIG. 17 is a diagram showing the hinge being in an open state according to an embodiment of the present invention, wherein the blocking member abuts against a second abutting part of the damper.
Figure 18:
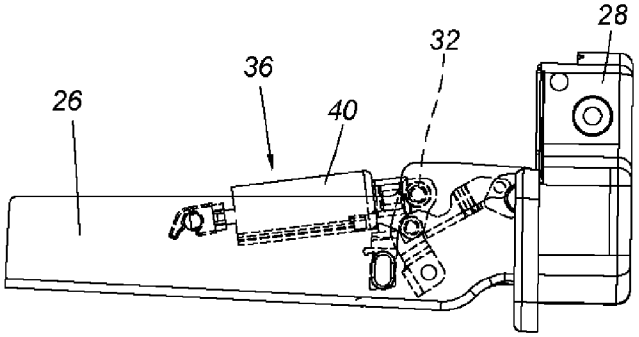
FIG. 18 is a diagram showing the hinge in FIG. 17 being in the close state.
Figure 19A:
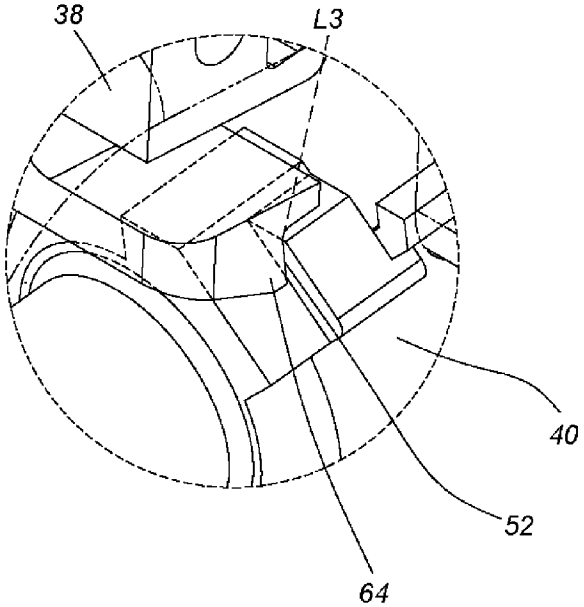
FIG. 19A is an enlarged view of an area 19A in FIG. 19.
Figure 19:
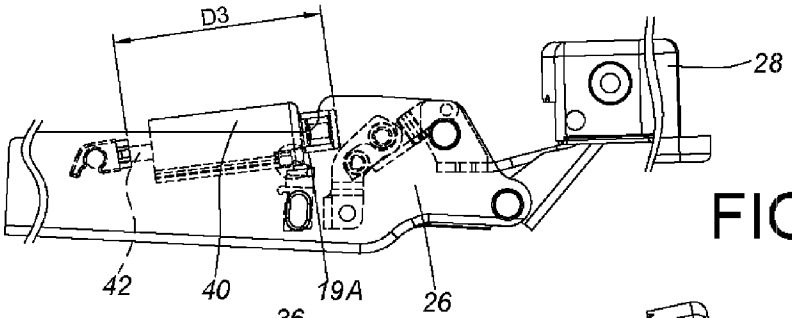
FIG. 19 is a diagram showing the hinge being in the open state according to an embodiment of the present invention, wherein the blocking member abuts against a third abutting part of the damper.
Figure 20:
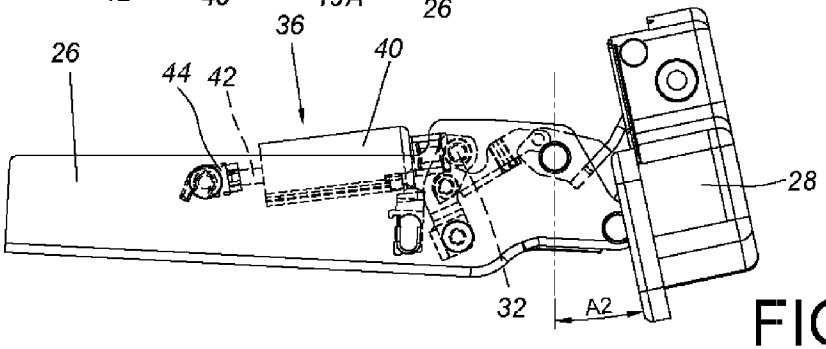
FIG. 20 is a diagram showing the linkage member pushing the damper in a process of the hinge in FIG. 19 being moved to switch from the open state to the close state when the second component of the hinge is at a second angle.
Figure 21:
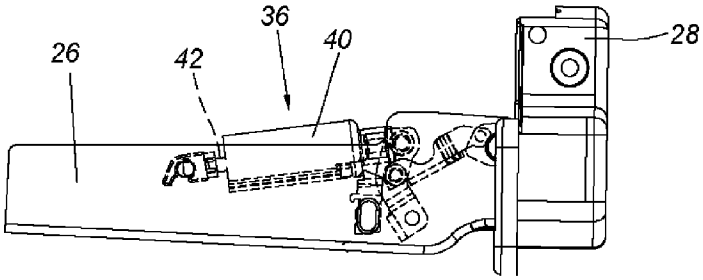
FIG. 21 is a diagram showing the hinge in FIG. 20 being in the close state.

As shown in FIG. 17, FIG. 17A and FIG. 18, when the blocking member 38 is adjusted to move to the second position L2, the flexible part 64 of the blocking member 38 abuts against the second abutting part 50 of the first movable member 40 of the damper 36, such that a second length D2 is defined by the first movable member 40 and the second movable member 42 of the damper 36. Wherein, the second length D2 is smaller than the first length D1. In such state, during the process of the second component 28 being moved to switch from the open state to the close state relative to the first component 26, the linkage member 32 starts to push (or contact) the first movable member 40 of the damper 36 when the second component 28 is nearly at the close state, such that a second damping effect provided by the damper 36 is almost zero. Or, in the state that the first movable member 40 and the second movable member 42 of the damper 36 define the second length D2, during the process of the second component 28 being moved to switch from the open state to the close state relative to the first component 26, the linkage member 32 does not push (or contact) the first movable member 40 of the damper 36 even the linkage member 32 is moved toward the first movable member 40 of the damper 36. In other words, the second damping effect provided by the damper 36 is zero during the process of the second component 28 being moved to switch from the open state to the close state relative to the first component 26.

As shown in FIG. 19, FIG. 19A, FIG. 20 and FIG. 21, when the blocking member 38 is adjusted to move to the third position L3, the flexible part 64 of the blocking member 38 abuts against the third abutting part 52 of the first movable member 40 of the damper 36, such that a third length D3 is defined by the first movable member 40 and the second movable member 42 of the damper 36. Wherein, the third length D3 is between the first length D1 and the second length D2. That is to say, the first length D1 is greater than the third length D3, and the third length D3 is greater than the second length D2. The relationship between the first to third lengths D1-D3 can be represented by an equation: D1>D3>D2. In such state, during the process of the second component 28 being moved to switch from the open state to the close state relative to the first component 26, the linkage member 32 is moved toward the first movable member 40 of the damper 36 along with the second component 28 rotating relative to the first component 26. Wherein, the linkage member 32 starts to push the first movable member 40 of the damper 36 when the second component 28 is moved relative to the first component 26 to be at a second angle A2. On the other hand, the second movable member 42 of the damper 36 abuts against the sleeve member 44. As such, when the linkage member 32 continues to push the first member 40 of the damper 36, the first movable member 40 of the damper 36 is moved relative to the second movable member 42 according to a damping stroke corresponding to the third length D3, in order to provide a third damping effect to mitigate movement of the second component 28 being closed relative to the first component 26. In other words, the third damping effect is provided when the second furniture part 24 is closed relative to the first furniture part 22.

Figure 23:
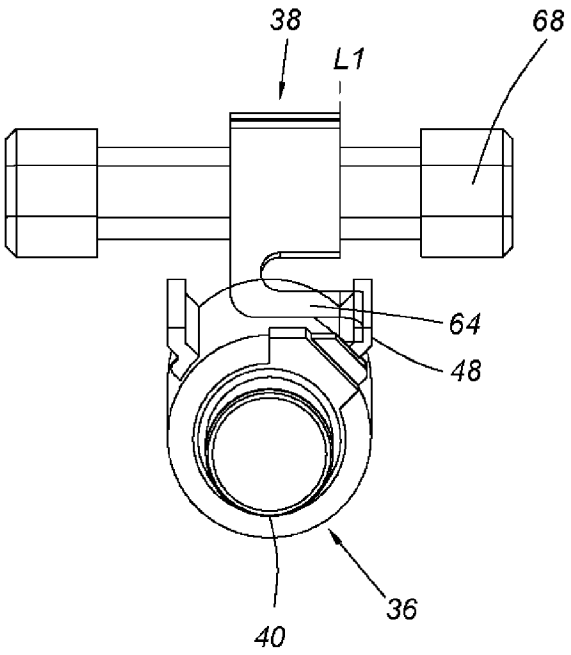
FIG. 23 is a diagram showing the blocking member in FIG. 22 being located at the first position relative to the damper in another angle.
Figure 22:
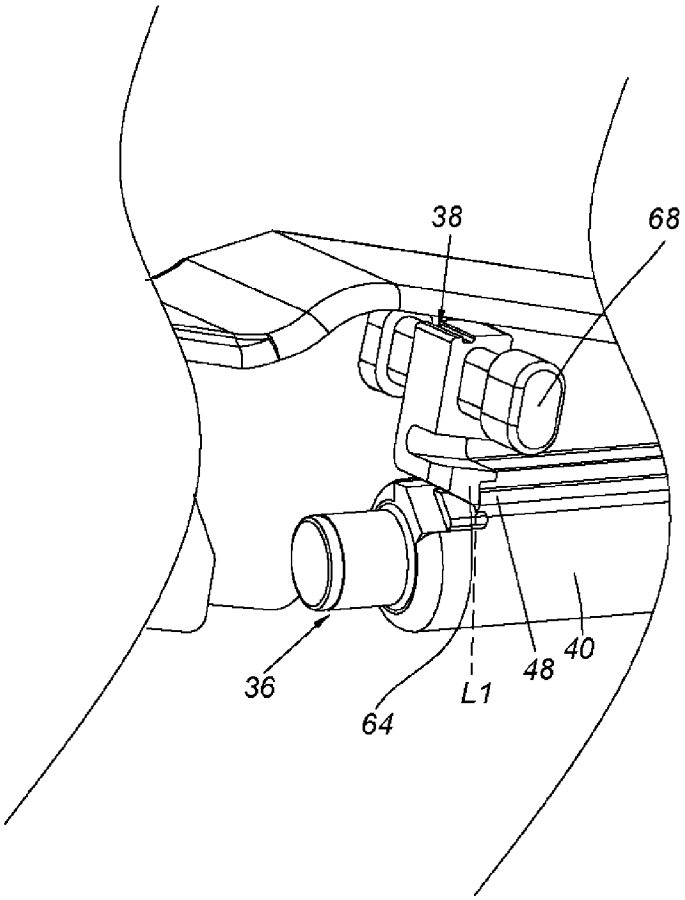
FIG. 22 is a diagram showing the blocking member being located at the first position relative to the damper according to an embodiment of the present invention.
Figure 25:
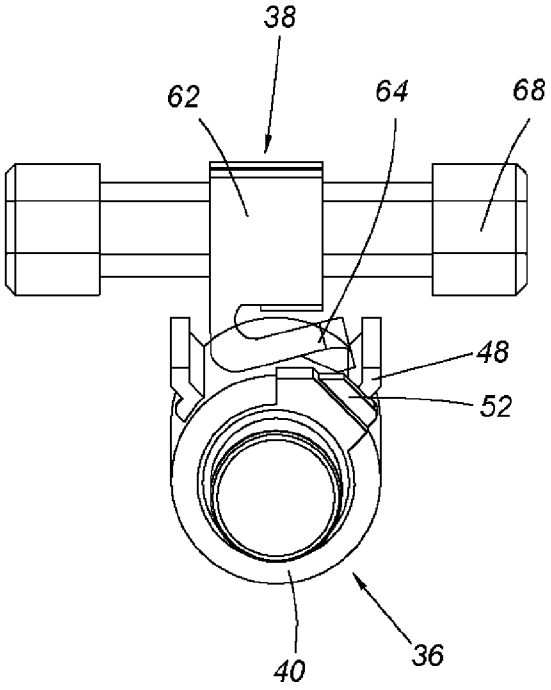
FIG. 25 is a diagram showing the blocking member in FIG. 24 being moved relative to the damper in another angle.
Figure 24:
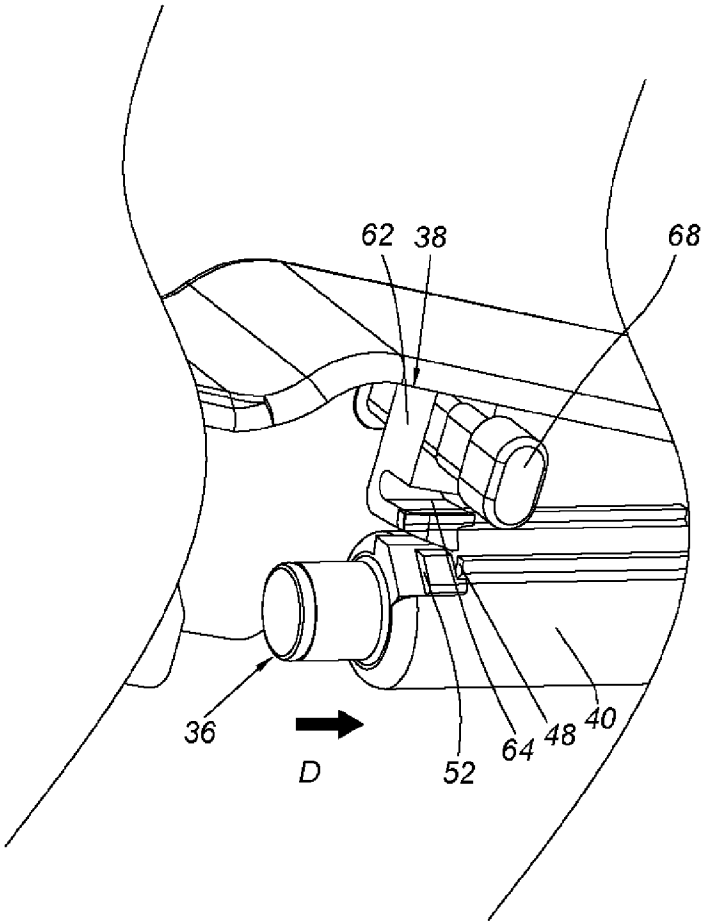
FIG. 24 is a diagram showing the blocking member in FIG. 22 being moved relative to the damper with a first movable member of the damper being moved along a direction.
Figure 27:
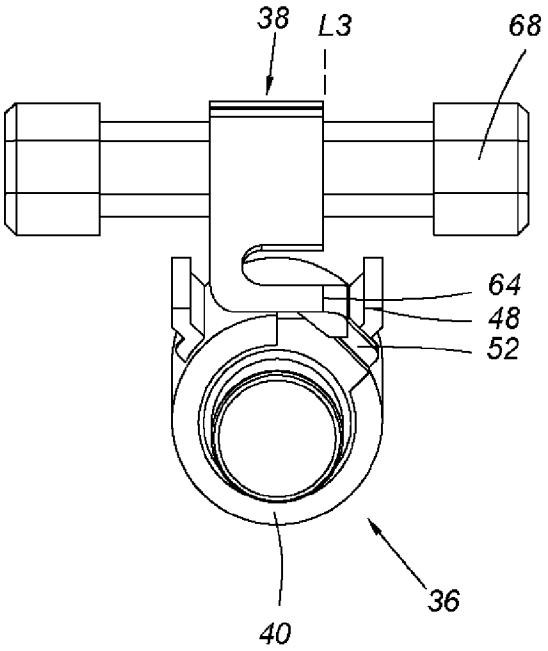
FIG. 27 is a diagram showing the blocking member in FIG. 26 being located at the third position relative to the damper in another angle.
Figure 26:
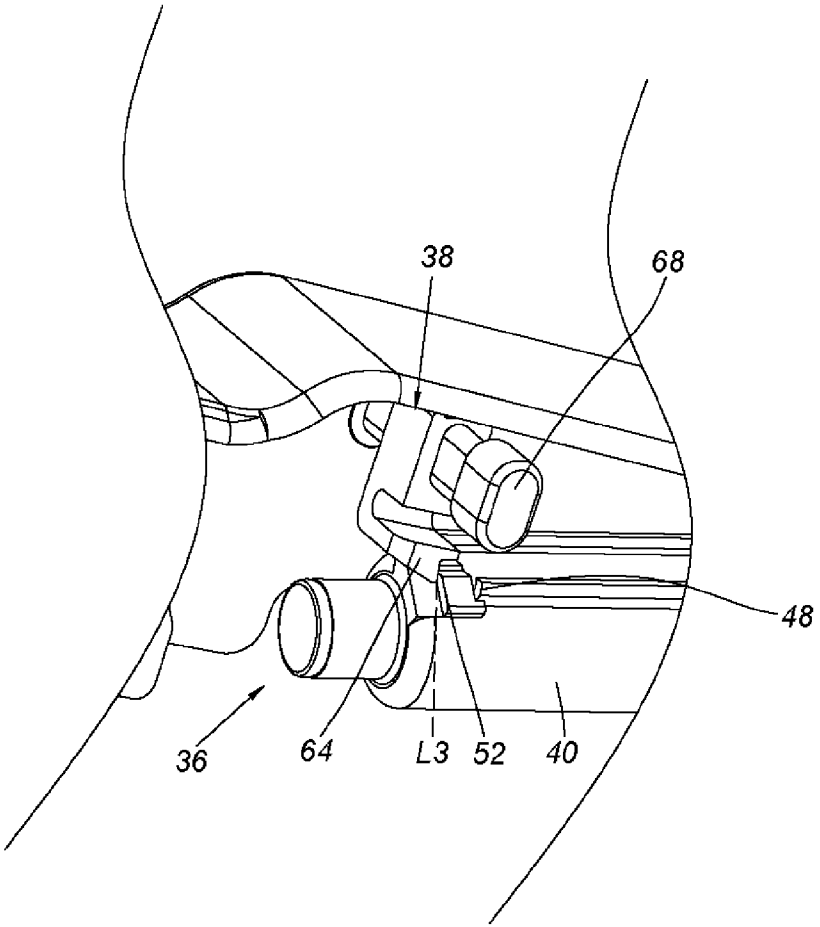
FIG. 26 is a diagram showing the blocking member being located at the third position relative to the damper according to an embodiment of the present invention.
Figure 29:
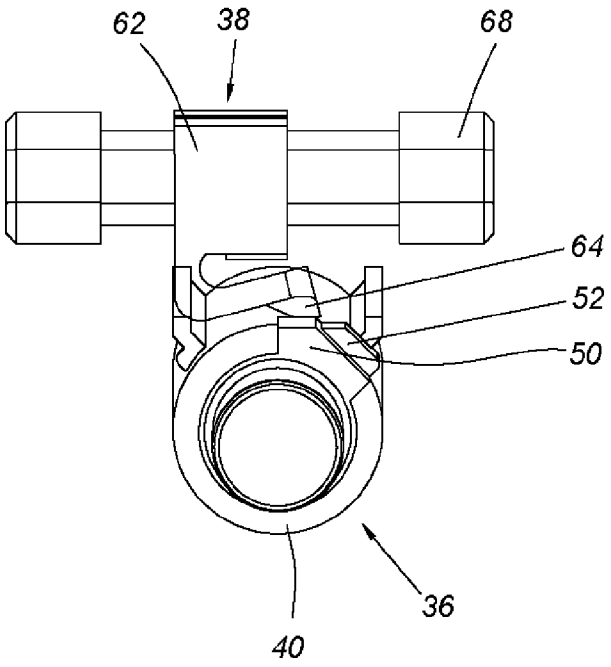
FIG. 29 is a diagram showing the blocking member in FIG. 28 being moved relative to the damper in another angle.
Figure 28:
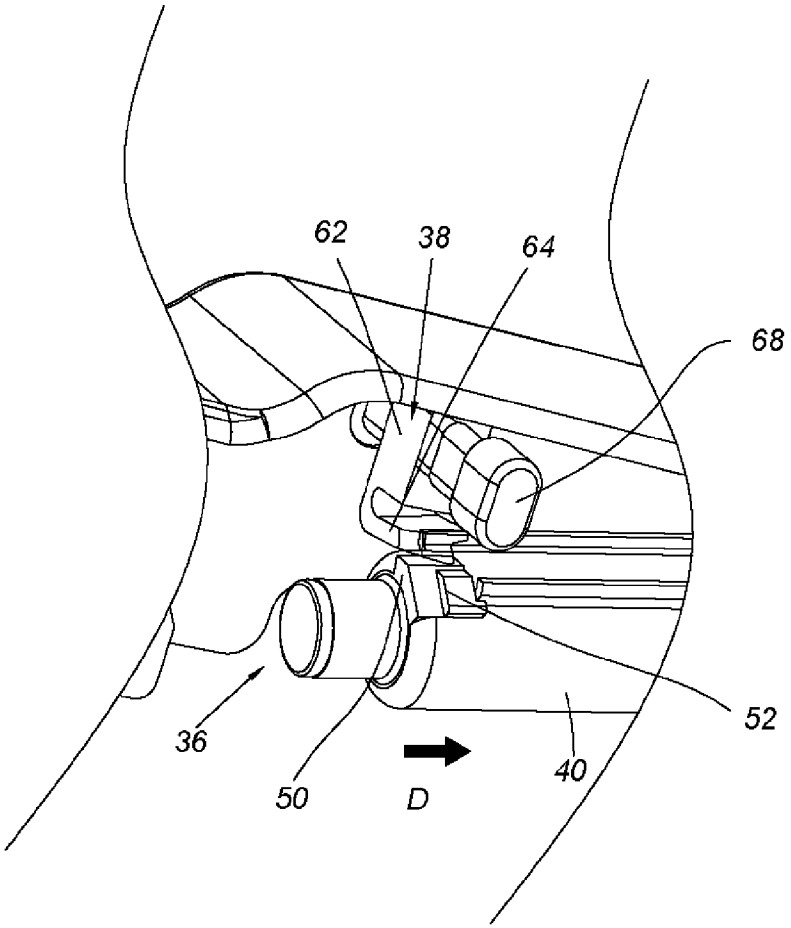
FIG. 28 is a diagram showing the blocking member in FIG. 26 being moved relative to the damper with the first movable member of the damper being moved along the direction.
Figure 31:
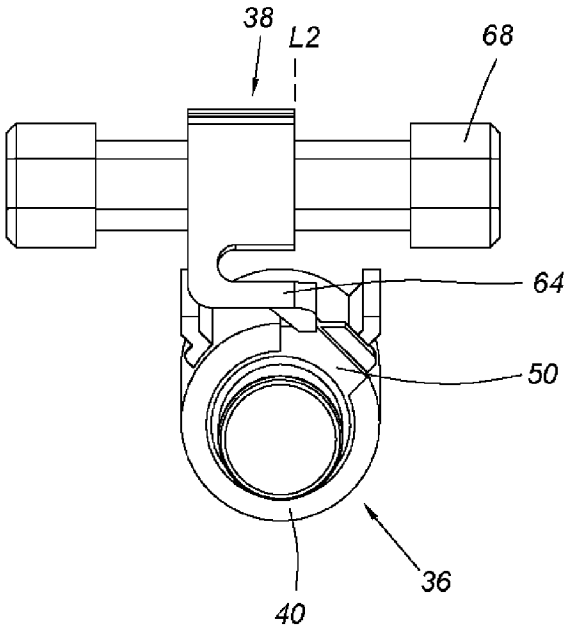
FIG. 31 is a diagram showing the blocking member in FIG. 30 being located at the second position relative to the damper in another angle.
Figure 30:
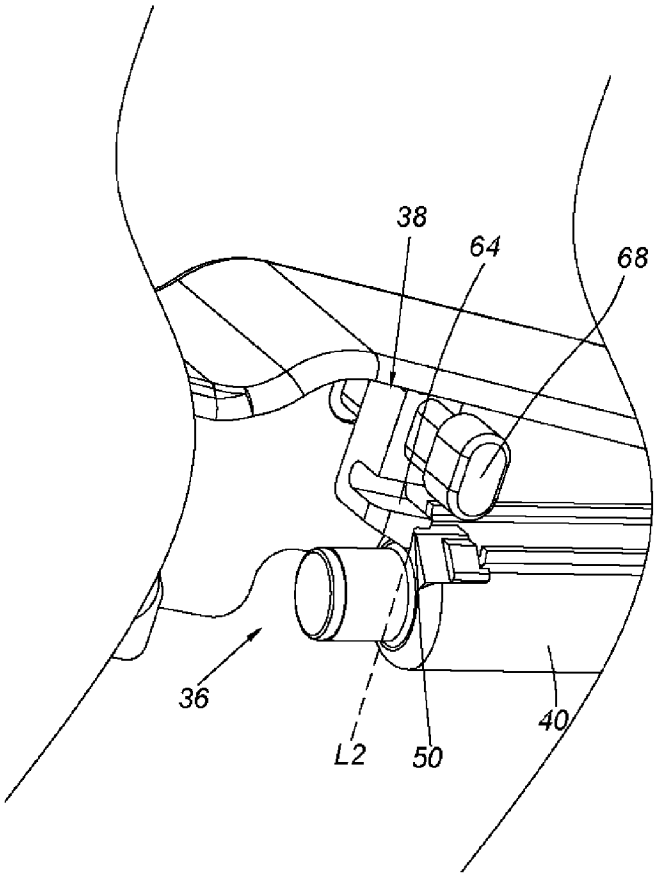
FIG. 30 is a diagram showing the blocking member being located at a second position relative to the damper according to an embodiment of the present invention.

As shown in FIG. 22 and FIG. 23, when the blocking member 38 is located at the first position L1 relative to the damper 36, the flexible part 64 of the blocking member 38 abuts against the first abutting part 48 of the first movable member 40 of the damper 36.

As shown in FIG. 24, FIG. 25, FIG. 26 and FIG. 27, in an operation mode, the blocking member 38 is operatively moved from the first position L1 to the third position L3 relative to the damper 36. For example, when the user operates the adjusting member 68 to move the blocking member 38 transversely (laterally) relative to the damper 36 from the first position L1 to the third position L3, the first movable member 40 of the damper 36 can be operatively moved relative to the second movable member 42 along a longitudinal direction D, such that the flexible part 64, which previously abutted against the first abutting part 48, is adjusted to abut against the third abutting part 52. In such process, the flexible part 64 of the blocking member 38 is pushed by a lateral side of the third abutting part 52 for accumulating an elastic force, and the flexible part 64 releases the elastic force to abut against the third abutting part 52 of the first movable member 40 of the damper 36 once the first movable member 40 is moved to a predetermined position along the longitudinal direction D.

As shown in FIG. 28, FIG. 29, FIG. 30 and FIG. 31, the blocking member 38 is operatively moved from the third position L3 to the second position L2 relative to the damper 36. For example, when the user operates the adjusting member 68 to move the blocking member 38 transversely (laterally) relative to the damper 36 from the third position L3 to the second position L2, the first movable member 40 of the damper 36 can be operatively moved relative to the second movable member 42 along the longitudinal direction D, such that the flexible part 64, which previously abutted against the third abutting part 52, is adjusted to abut against the second abutting part 50. In such process, the flexible part 64 of the blocking member 38 is pushed by a lateral side of the second abutting part 50 for accumulating an elastic force, and the flexible part 64 releases the elastic force to abut against the second abutting part 50 of the first movable member 40 of the damper 36 once the first movable member 40 is moved to another predetermined position along the longitudinal direction D.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A damping device, comprising:

a damper arranged on a component and comprising a first movable member and a second movable member longitudinally movable relative to each other, the first movable member having a first abutting part and a second abutting part, the first abutting part and the second abutting part being located at different positions on the first movable member along a longitudinal direction of the first movable member;

a blocking member arranged on the component and movable relative to the damper, the blocking member configured to abut against one of the first abutting part and the second abutting part of the first movable member; and an adjusting member configured to adjust the blocking member to transversely move relative to the damper, in order to change a relative position between the blocking member and the damper.

2. The damping device of claim 1, further comprising a housing having a passage configured to accommodate the damper, wherein the adjusting member is arranged adjacent to the housing.

3. The damping device of claim 2, wherein the housing further comprises an auxiliary base arranged adjacent to the passage, the auxiliary base has a plurality of engaging features, the blocking member is arranged on the auxiliary base, and the blocking member has a positioning feature configured to be engaged with one of the plurality of engaging features.

4. The damping device of claim 1, wherein the blocking member has an opening, and the adjusting member comprises a first fastening member and a second fastening member penetrating through the opening and fastened to each other.

5. The damping device of claim 1, wherein the first movable member further has a third abutting part located at a position different from the positions of the first abutting part and the second abutting part on the first movable member along the longitudinal direction of the first movable member, the blocking member comprises a main body and a flexible part connected to the main body, the flexible part is configured to selectively abut against one of the first abutting part, the second abutting part and the third abutting part.

6. The damping device of claim 1, wherein the first movable member of the damper is a cylinder, and the second movable member of the damper is a piston rod.

7. A damping device, applicable to a first component and a second component movable relative to each other, the first component having a contact part, the damping device comprising:

a housing arranged on the first component;

a damper arranged in the housing, the damper comprising a first movable member and a second movable member longitudinally movable relative to each other, a length being defined by the first movable member and the second movable member, the first movable member having a first abutting part and a second abutting part, the first abutting part and the second abutting part being located at different positions on the first movable member along a longitudinal direction of the first movable member, the second movable member configured to abut against the contact part;

a blocking member arranged on the first component and movable relative to the damper, the blocking member configured to abut against one of the first abutting part and the second abutting part of the first movable member in order to adjust the length; and an adjusting member configured to adjust the blocking member to transversely move relative to the damper, in order to change a relative position between the blocking member and the damper.

8. The damping device of claim 7, wherein the housing has a passage configured to accommodate the damper, the adjusting member is arranged adjacent to the housing.

9. The damping device of claim 8, wherein the housing further comprises an auxiliary base arranged adjacent to the passage, the auxiliary base has a plurality of engaging features, the blocking member is arranged on the auxiliary base, and the blocking member has a positioning feature configured to be engaged with one of the plurality of engaging features.

10. The damping device of claim 7, wherein the blocking member has an opening, and the adjusting member comprises a first fastening member and a second fastening member penetrating through the opening and fastened to each other.

11. The damping device of claim 7, wherein the first movable member further has a third abutting part located at a position different from the positions of the first abutting part and the second abutting part on the first movable member along the longitudinal direction of the first movable member, the blocking member comprises a main body and a flexible part connected to the main body, the flexible part is configured to selectively abut against one of the first abutting part, the second abutting part and the third abutting part in order to adjust the distance.

12. The damping device of claim 7, wherein the first movable member of the damper is a cylinder, and the second movable member of the damper is a piston rod.

13. A hinge, comprising:

a first component comprising a contact part;

a second component pivoted to the first component;

an elastic member configured to provide an elastic force when the second component is opened or closed relative to the first component;

a linkage member configured to move when the second component is rotated relative to the first component, wherein when the second component is opened relative to the first component, the elastic member provides the elastic force to the linkage member; and a damping device mounted to the first component, the damping device comprising:

a damper arranged on the first component and comprising a first movable member and a second movable member longitudinally movable relative to each other, the first movable member having a first abutting part and a second abutting part, the first abutting part and the second abutting part being located at different positions on the first movable member along a longitudinal direction of the first movable member, the second movable member facing toward the contact part of the first component; and a blocking member arranged on the first component and movable relative to the damper, the blocking member configured to abut against one of the first abutting part and the second abutting part of the first movable member;

wherein when the second component is moved to switch from an open state to a close state relative to the first component with the blocking member abutting against one of the first abutting part and the second abutting part of the first movable member, the linkage member is moved toward the first movable member of the damper.

14. The hinge of claim 13, wherein the first movable member further has a third abutting part located at a position different from the positions of the first abutting part and the second abutting part on the first movable member along the longitudinal direction of the first movable member.

15. The hinge of claim 14, wherein the damping device further comprises an adjusting member configured to adjust the blocking member to transversely move relative to the damper, in order to change a relative position between the blocking member and the damper for allowing the blocking member to selectively abut against one of the first abutting part, the second abutting part and the third abutting part of the first movable member.

16. The hinge of claim 15, wherein the damping device further comprises a housing arranged on the first component, the housing has a passage configured to accommodate the damper, the adjusting member is arranged adjacent to the housing.

17. The hinge of claim 15, wherein the blocking member comprises a main body and a flexible connected to the main body, the main body has an opening, the adjusting member comprises a first fastening member and a second fastening member penetrating through the opening and fastened to each other, the flexible part of the blocking member is configured to selectively abut against one of the first abutting part, the second abutting part and the third abutting part.

18. The hinge of claim 14, further comprising a sleeve member detachably mounted to the contact part of the first component, the sleeve member configured to abut against the second movable member of the damper.

* * * * *